US005639266A

United States Patent [19]

Patel

[11] Patent Number: 5,639,266

[45] Date of Patent: Jun. 17, 1997

[54] HIGH FREQUENCY ELECTRICAL CONNECTOR

[75] Inventor: Anila Patel, New Freedom, Pa.

[73] Assignee: Stewart Connector Systems, Inc., Glen Rock, Pa.

[21] Appl. No.: 327,425

[22] Filed: Oct. 21, 1994

Related U.S. Application Data

[63] Continuation-in-part of Ser. No. 179,983, Jan. 11, 1994.

[51] Int. Cl.[6] ..... H01R 23/02

[52] U.S. Cl. ..... 439/676; 439/941

[58] Field of Search ..... 439/60, 676, 924, 439/928, 929, 894, 894.1, 636, 637, 885, 941

[56] References Cited

U.S. PATENT DOCUMENTS

| | | | |
|---|---|---|---|
| 4,934,961 | 6/1990 | Piorunneck et al. | 439/637 |
| 4,996,766 | 3/1991 | Piorunneck et al. | 439/637 |
| 5,024,609 | 6/1991 | Piorunneck | 439/60 |
| 5,186,647 | 2/1993 | Dankmann et al. | 439/395 |
| 5,259,768 | 11/1993 | Brunker et al. | 439/60 |
| 5,282,754 | 2/1994 | Kish et al. | 439/108 |
| 5,295,869 | 3/1994 | Siemon et al. | 439/620 |
| 5,299,956 | 4/1994 | Brownell et al. | 439/638 |
| 5,310,363 | 5/1994 | Brownell et al. | 439/676 |
| 5,328,390 | 7/1994 | Johnston et al. | 439/638 |

*Primary Examiner*—David L. Pirlot

*Attorney, Agent, or Firm*—Steinberg, Raskin & Davidson, P.C.

[57] ABSTRACT

A high frequency electrical connector including a plurality of parallel contacts, a plurality of terminals, and conductors interconnecting the contacts to the terminals in a manner such that signals flowing through proximate contacts are transmitted in opposite directions to reduce near-end crosstalk.

32 Claims, 4 Drawing Sheets

HIGH FREQUENCY ELECTRICAL CONNECTOR

BACKGROUND OF THE INVENTION

This application is a continuation-in-part of application Ser. No. 08/179,983 filed Jan. 11, 1994.

This invention relates generally to electrical connectors and, more particularly, to an electrical connector for use in the transmission of high frequency signals.

Data communication networks are being developed which enable the flow of information to ever greater numbers of users at ever higher transmission rates. A problem is created, however, when data is transmitted at high rates over a plurality of circuits of the type that comprise multi-pair data communication cable. In particular, at high transmission rates, each wiring circuit itself both transmits and receives electromagnetic radiation so that the signals flowing through one circuit or wire pair (the "source circuit") may couple with the signals flowing through another wire pair (the "victim circuit"). The unintended electromagnetic coupling of signals between different pairs of conductors of different electrical circuits is called crosstalk and is a source of interference that often adversely affects the processing of these signals. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. The EIA/TIA of ANSI has promulgated electrical specifications for near-end crosstalk isolation in network connectors to ensure that the connectors themselves do not compromise the overall performance of the unshielded twisted pair interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

While it is desirable to use modular connectors for data transmission for reasons of economy, convenience and standardization, such connectors generally comprise a plurality of electrical contacts and conductors that extend parallel and closely spaced to each other thereby creating the possibility of excessive near-end crosstalk at high frequencies.

High speed data transmission cable typically comprise four circuits defined by eight wires arranged in four twisted pairs. The cable is typically terminated by modular plugs having eight contacts, and specified ones of the four pairs of the plug contacts are assigned to terminate respective specified ones of the four cable wire pairs according to ANSI/EIA/TIA standard 568. In particular, the standard 568 contact assignment for the wire pair designated "1" is the pair of plug contacts located at the 4–5 contact positions. The cable wires of the pair designated "3" are, according to standard 568, terminated by the plug contacts located at the

3–6 positions which straddle the "4–5" plug contacts that terminate wire pair "1". Near-end crosstalk between wire pairs "1" and "3" during high speed data transmission has been found to be particularly troublesome in connectors that terminate cable according to standard 568.

When crosstalk occurs between electrically distinct circuits that are separated by a distance of much less than one wavelength, signal energy is transferred from one circuit to another either through inductive coupling, capacitive coupling, or a combination of the two. For Category 5 interconnects, the shortest wavelength of interest is 3 meters, corresponding to the highest frequency of operation, 100 MHz. Since connector contact spacing in Category 5 connectors is much less than 3 meters, capacitive (electric field) and/or inductive (magnetic field) coupling will be responsible for measurable crosstalk within the connector.

Capacitive coupling will dominate when:

1) source circuits switch large voltages very quickly (large dv/dt) and/or operate at relatively high impedance levels ($>>1k\Omega$);

2) source and/or victim circuits have large surface areas (wide, long conductors); and 3) source and victim circuits are closely spaced and separated by dielectrics (non-conductors) that increase mutual capacitance between the source and victim circuits.

Inductive coupling will dominate when:

1) source circuits switch large currents very quickly (large di/dt) and/or operate at relatively high impedance levels ($<<100\Omega$);

2) source and/or victim circuits enclose large loop areas; and 3) source and victim circuits are closely spaced and have their current loops oriented along parallel axes.

SUMMARY OF THE INVENTION

Accordingly, it is an object of the present invention to provide new and improved connectors for use in data transmission at high frequencies.

Another object of the present invention is to provide new and improved high frequency connectors which reduce near-end crosstalk.

Still another object of the present invention is to provide new and improved modular connectors which reduce near-end crosstalk.

A still further object of the present invention is to provide new and improved high frequency electrical connectors which reduce near-end crosstalk and which are simple and inexpensive in construction.

Yet another object of the present invention is to provide new and improved modular jacks which reduce near-end crosstalk when connected to modular plugs that terminate high speed data transmission cable according to ANSI/EIA/TIA standard 568.

Briefly, these and other objects are attained by providing an electrical connector comprising a plurality of substantially parallel contacts, a plurality of terminals, such as pin-type terminals, and means for interconnecting the contacts to respective terminals such that signals transmitted through at least one pair of adjacent contacts flow in opposite directions. Signal flow in opposite directions through proximate contacts creates self-cancelling magnetic and inductive fields which reduce near-end crosstalk. The means for interconnecting the contacts to the terminals comprise one or more first conductors which interconnect first end regions of respective one or more first contacts to respective one or more terminals, and one or more second conductors which interconnect second end regions opposite from the first end regions of the first contacts of respective one or more second contacts which are proximate to the first contacts to a respective one or more terminals.

In a preferred embodiment, the connector comprises a modular jack having a plurality of contact/terminal wires, each of which defines a contact, a pin-like terminal, and a conductor portion interconnecting the contact and terminal. A first set of the contact/terminal wires are configured to define a first set of jack contacts that "face rearwardly", i.e., the free ends of the jack contacts face toward the closed end of the jack with the respective jack terminals being interconnected to these contacts at the region of the open end of the jack so that signals transmitted through the contacts of the first set flow toward the open end of the jack. On the other hand, a second set of the contact/terminal wires are configured to define a second set of jack contacts that "face forwardly", i.e., the free ends of the jack contacts face toward the open end of the jack with the respective jack terminals being interconnected to these contacts at the region of the closed end of the jack so that signals transmitted through the contacts of the second set flow toward the closed end of the jack, i.e., in a direction substantially opposite to the direction in which the signals flow through the contacts of the first set.

In the case of an eight contact, eight position modular jack adapted for connection to a modular plug terminating an eight wire cable in accordance with the wire-contact assignments specified by ANSI/EIA/TIA standard 568, near-end crosstalk is reduced to a maximum extent when the jack contacts in positions 3 and 5 are forward facing contacts while the jack contacts in positions 1, 2, 4 and 6–8 are rearward facing contacts.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENT

Figure 1A:
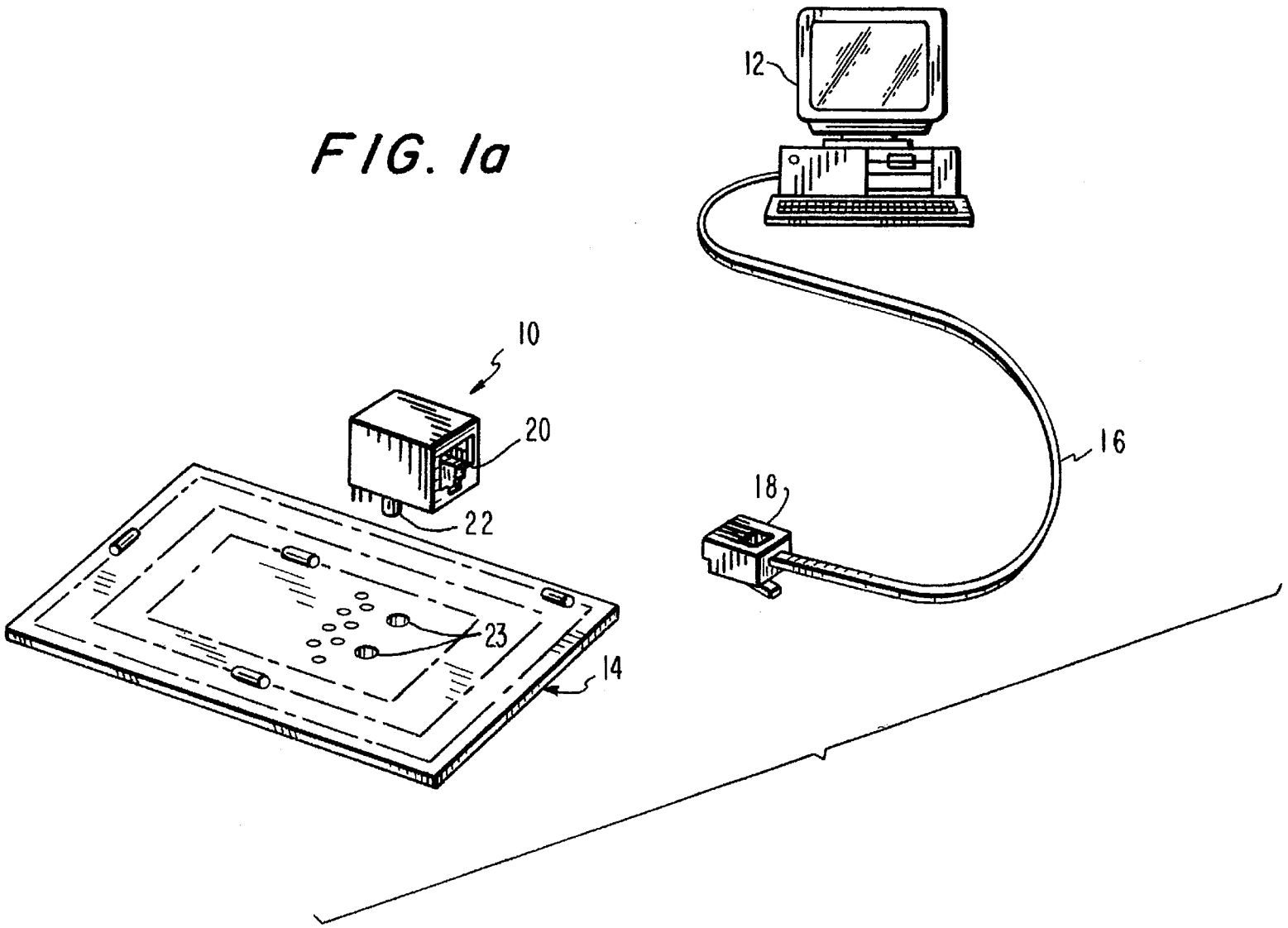
FIG. 1*a* shows in exploded schematic perspective a jack connector in accordance with the invention in use for coupling high speed communication equipment to a printed circuit board via a communication cable terminated by a modular plug.
Figure 1B:
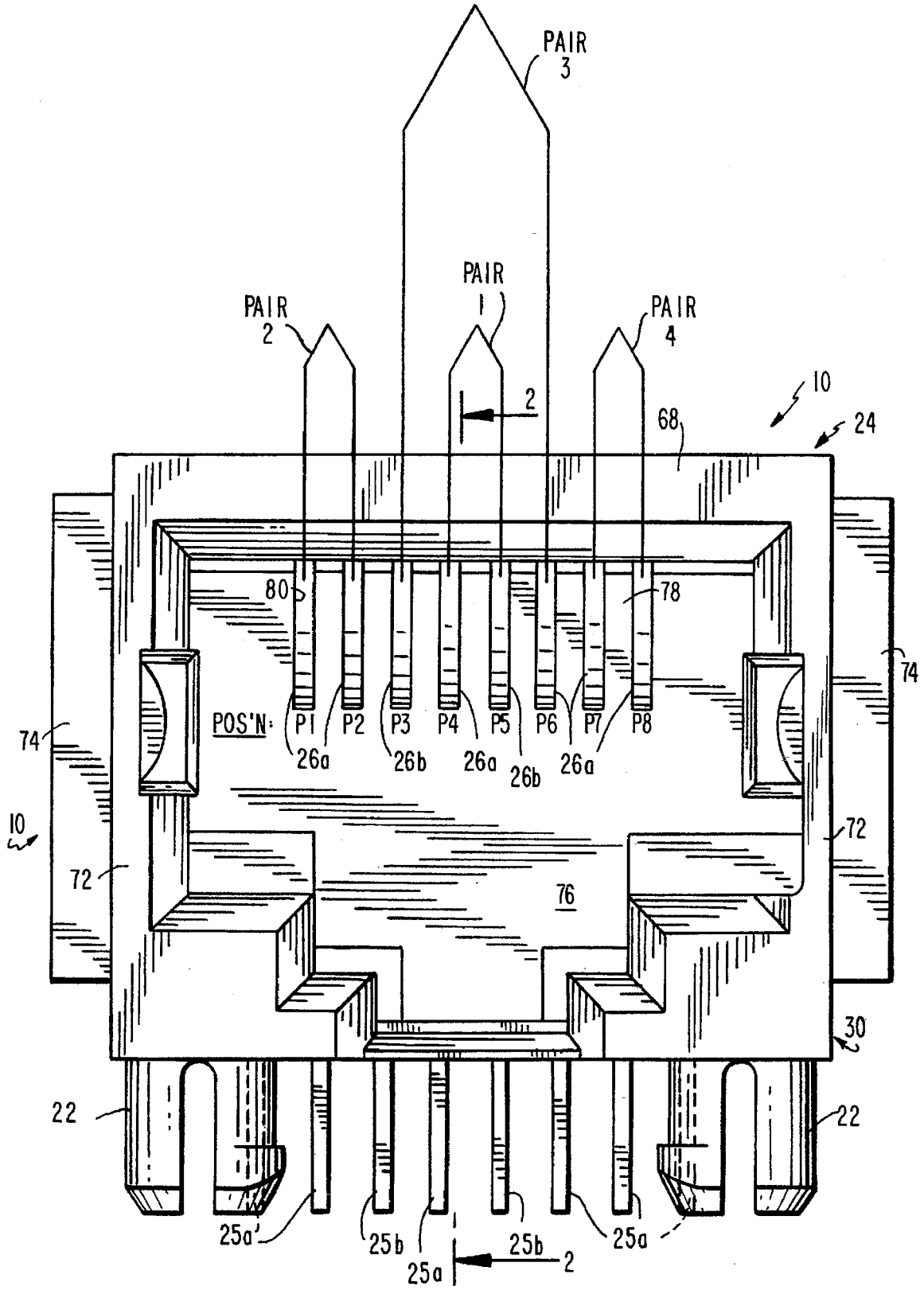
FIG. 1*b* is a front elevation view of a jack connector in accordance with an embodiment of the invention illustrating the wire-plug contact assignments specified for a mating plug by ANSI/EIA/TIA standard 568 by reference to the jack contacts to be engaged by those plug contacts.

Referring now to the drawings wherein like reference characters designate identical or corresponding parts throughout the several views, FIG. 1*a* illustrates a jack 10 in accordance with the invention for coupling high speed communication hardware 12 to a printed circuit board 14 via a high speed communication cable 16 terminated by a modular plug 18. The jack 10 has a receptacle 20 adapted to receive the modular plug 18. Coupling of the hardware 12 to the printed circuit board 14 is made more convenient by the use of connectors 10 and 18 having standard modular features of the type specified in sub-part F of F.C.C. part 68.500. The connector 10 is mechanically mounted to the printed circuit board 14 by means of posts 22 which are received in corresponding openings 23 in the printed circuit board.

As noted above, problems arise in the use of conventional modular jacks for high speed data transmission because of the necessary close spacing between the jack contacts and other electrical conductors of the connector. More particularly, modular jacks generally include a plurality of closely spaced, substantially parallel wire contacts adapted to be engaged by blade-like contacts of the modular plugs. The wire contacts are coupled to pin-like terminals of the jack, generally by length portions of common contact/terminal wires, which in turn are connected to the printed circuit. When a modular plug is inserted into the receptacle of a modular jack, the contact blades of the plug engage respective wire contacts of the jack. The signals flowing between the wire contacts and the pin-like terminals of each transmission circuit create electromagnetic and inductive fields which undesirably couple to other circuits through adjacent jack contacts resulting in near-end crosstalk.

In accordance with the present invention, the wire contacts of the connector are interconnected to respective pin-like connector terminals in a manner such that the signals that flow through the contacts of at least one pair of adjacent contacts flow in opposite directions, rather than in the same direction as is conventional. In this manner, electromagnetic and inductive fields created by the opposite signal flows in adjacent and/or proximate contacts tend to substantially cancel each other thereby substantially reducing signal coupling in the connector, i.e. substantially decreasing near-end crosstalk.

Referring to FIGS. 1*b* and 2–5, a jack 10 in accordance with a preferred embodiment of the invention comprises a dielectric housing 24 and a plurality of conductive contact/terminal wires 110*a* and 110*b*. Contact/terminal wires 110*a*, of which there are six, are configured to form a first set of rearward facing contacts 26*a* and associated pin-like terminals 25*a* while contact/terminal wires 110*b*, of which there are two, are configured to form a second set of forward facing contacts 26*b* and associated pin-like terminals 25*b*. In other words, the free ends 27*a* of contacts 26*a* are situated near and face toward the closed end of jack receptacle 20 while the free ends 27*b* of contacts 26*b* are situated near and face toward the entrance opening 21 of receptacle 20. The contacts 26*a* and 26*b* are substantially parallel and extend obliquely through jack receptacle 20 between upper positions proximate to the forward entrance opening 21 and lower positions at the rear of the receptacle. Jack 10 includes eight contacts 26 (six contacts 26*a* and two contacts 26*b*) and is constructed specifically for use with an eight contact modular plug terminating a four wire pair transmission cable with wire-contact assignments as specified by ANSI/EIA/TIA standard 568. However, it is understood that a connector in accordance with the principles of the invention may include more or less than eight contacts.

The contact/terminal wires 110*a* and 110*b* are shaped and associated with jack housing 24 as described below so that when the contacts 26*a* and 26*b* are engaged by the contact blades 19 (FIG. 2) of the modular plug 18, the signals flow through the first rearward facing contacts 26*a* to their associated terminals 25*a* in a direction (designated by arrow 29*a* in FIG. 2) opposite to the direction in which the signals flow through the second forward facing contacts 26*b* toward their associated terminals 25*b* (designated by arrow 29*b* in FIG. 2).

The rearward facing contacts 26*a* alternate in position with the forward facing contacts 26*b* in accordance with an arrangement which has been found to maximize isolation of near-end crosstalk when jack 10 is coupled to a modular plug whose contacts are assigned to terminate the cable wires according to ANSI/EIA/TIA standard 568. Twisted wire pair "3" assigned to plug/jack contacts at positions "P3" and "P6" is typically used to transmit and receive information in such cable. The jack contacts that are situated at positions "P4" and "P5" and which are engaged by corresponding plug contacts that terminate the twisted wire pair designated "1" are rearward and forward facing contacts 26*a* and 26*b* respectively. The jack contacts situated at positions "P3" and "P6" (that straddle the contacts in positions "P4" and "P5") and which are engaged by corresponding plug contacts that terminate the twisted wire pair "3" are forward and rearward facing contacts 26*b* and 26*a* respectively. The jack contacts situated at positions "P1" and "P2" and which are engaged by corresponding plug contacts that terminate twisted wire pair "2" are both rearward facing contacts 26*a* as are the jack contacts situated at positions "P7" and "P8" that are engaged by corresponding plug contacts that terminate twisted wire pair "4". It has been found that with this particular positional arrangement of the eight forward facing (F) and rearward facing (R) jack contacts, i.e., RRFRFRRR, optimum isolation for source/victim twisted wire pairs "1" and "3" (which generally generate the greatest NEXT) is achieved when coupled to an eight position modular plug whose contacts are assigned to terminate 4 twisted wire pair cable according to ANSI EIA/TIA standard 568. This is accomplished without introducing additional NEXT failures associated with the jack contacts at positions "P4"–"P5" (wire pair "1") and the jack contacts at positions "P1"–"p2" (wire pair "2") or "P7"–"P8" (wire pair "4").

Jack housing 24 comprises a contact housing part 28 and an outer housing part 30 formed of suitable plastic material which together define the receptacle 20 for receiving a modular plug of the type designated 18 in FIG. 1*a*. Contact housing part 28 has a generally L-shaped configuration including a back portion 34 and a frame-shaped top portion 36 extending from the top of the back portion 34 in a cantilever fashion. A first set of four tapered parallel bores 40 extend through the rear part of the back portion 34, and a second set of four tapered parallel bores 40 extend through the front part of back portion 34. As seen in FIGS. 2 and 3, the central upper region of the front part of back portion 34 is notched out at 41 so that the two of the four bores 40, designated 40', that extend through the front part of back portion 34 at locations corresponding to contact positions 3 and 5, open onto an upwardly facing surface 42 situated at about the mid-height of back portion 34. Thus, six full height bores 40 open onto the top surface of back portion 34 while two bores 40' open onto the surface 42 situated at the mid-height of the back portion. As best seen in FIG. 3, the frame-shaped top portion 36 includes a pair of elongate side portions 44 projecting forwardly from the upper end of back portion 34 and a transversely extending front portion 46 extending transversely between side portions 44. Guide channels 48 are formed on the upper surface of front portion 46 at locations corresponding to contact positions P1, P2, P4 and P6–P8, i.e., at locations corresponding to the positions of rearward facing contacts 26*a* and curve around to the lower surface of the front portion 46 with the curved portion recessed behind the front surface 46' of front portion 46. As seen in FIGS. 2 and 3, the transverse front portion 46 has upwardly facing stop surfaces 50 formed at locations corresponding to contact positions P3 and P5, i.e., at locations corresponding to the positions of forward facing contacts 26*b*.

Each of the six "rearward" contact/terminal wires 110*a* is formed of an appropriate resilient conductive material, such as phosphor bronze, and is shaped to include a length portion defining a rearwardly facing contact 26*a*, a length portion defining an associated pin-like terminal 25*a* and a length portion defining a conductor 112*a* interconnecting the contact 26*a* from its front end 26*a*' to terminal 25*a*. The rearward contact/terminal wires 110*a* are assembled to contact housing part 28 as follows. Each pin-like terminal 25*a* is positioned in a respective one of the six full height bores 40 and has a length such that a bottom length portion 25*a*' projects out from the bottom of bore 40 for connection to the printed circuit. Each conductor 112*a* extends longitudinally from the upper end of a respective terminal 25*a* across the open space defined by frame-shaped top portion 36 and is received in a respective one of the guide channels 48 formed in front portion 46. Each contact 26*a* extends rearwardly in a downward direction from the curved front end of a respective conductor 112*a* situated in a guide channel 48 and terminates at the free end 27*a*.

Each of the two "forward" contacts/terminal wires 110*b* is also formed of resilient conductive material and is shaped to include a length portion defining forwardly facing contact 26*b*, a length portion defining an associated pin-like terminal 25*b* and a length portion defining a conductor 112*b* interconnecting the contact 26*b* from its rear end 26*b*' to terminal 25*b*. The forward contact/terminal wires 110*b* are assembled to contact housing part 28 as follows. Each pin-like terminal 25*b* is positioned in a respective one of the two shorter bores 40' and has a length such that a bottom length portion 25*b*' projects out from the bottom of bore 40' for connection to the printed circuit. Each conductor 112*b* extends longitudinally from the upper end of a respective terminal 25*b* for a relatively short distance. Each contact 26*b* extends forwardly in an upward direction from the front end of a respective conductor 112*b* and terminates at the free end 27*b* which is shaped to overlie a respective one of the stop surfaces 50 (FIG. 2) formed in front portion 46.

The outer housing part 30 comprises a unitary member formed by opposed top and bottom walls 68 and 70 and opposed side walls 72 defining an interior space between them. Posts 22 project downwardly from the bottom wall 70 for connecting the jack to the printed circuit board. A pair of flanges 74 project laterally from side walls 72 for facilitating mounting of the jack to a chassis, if desired.

A wall 76 extends upwardly from bottom wall 70 and divides the interior of the outer housing part 30 into a forward space comprising receptacle 20 in which the modular plug is received and a rearward space for receiving the back portion 34 of contact housing part 28. A plurality of spaced partitions 78 are formed at the upper end of wall 76 that define eight guide slots 80 between them and which terminate at their upper ends at a distance spaced from the top wall 68 of outer housing part 30.

In assembly, the contact housing part 28 and associated contact/terminal wires 110*a* and 110*b* are inserted into the outer housing part 30 from its rear end. Rails 82 on the contact housing part are received in corresponding channels (not shown) formed in the outer housing part. During insertion, the six rearward facing contacts 26*a* are aligned with and received in the guide slots 80 corresponding to jack contact positions 1, 2, 4 and 6–8, while the two forward facing contacts 26*b* are aligned with and received in the guide slots 80 corresponding to jack contact positions 3 and 5. The partitions 78 serve to precisely position the rearward and forward facing contacts 26*a* and 26*b* and prevent them from contacting each other during operation. A locking shoulder 86 formed on each side of the back portion 34 of contact housing part 28 snaps into engagement with a corresponding shoulder (not shown) in the outer housing part 30 to lock the contact housing part and associated contacts to the outer housing part.

Figure 2:
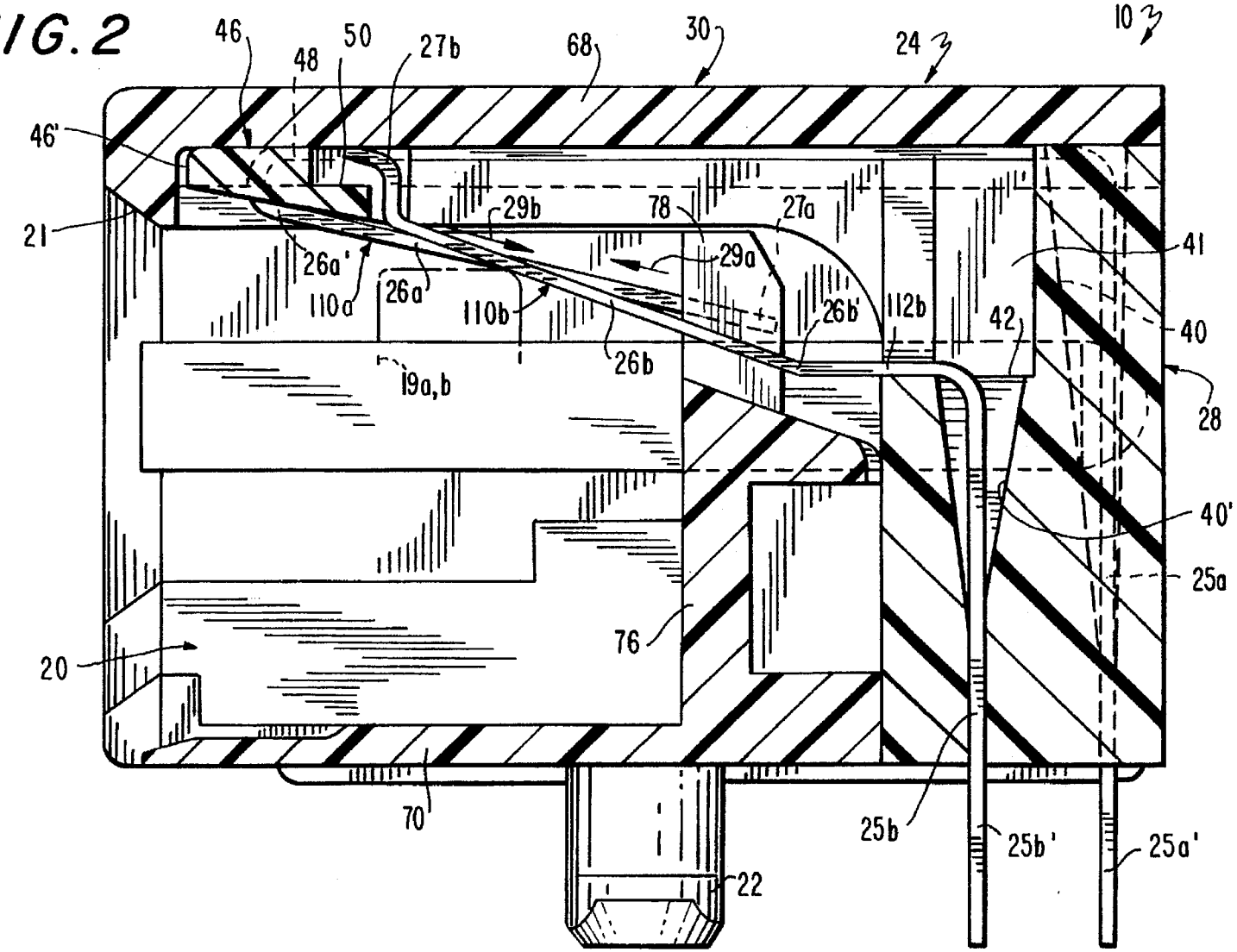
FIG. 2 is a longitudinal section view of the jack illustrated in FIG. 1*b* taken along line 2—2 of FIG. 1*b;*
Figure 3:
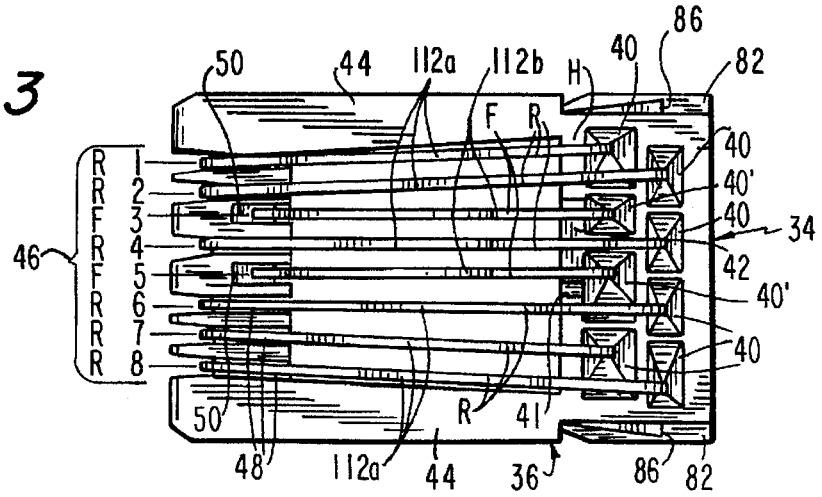
FIG. 3 is a top plan view of an assembly of the contact housing part and the contact/terminal wires of the jack illustrated in FIGS. 1 and 2.
Figure 4:
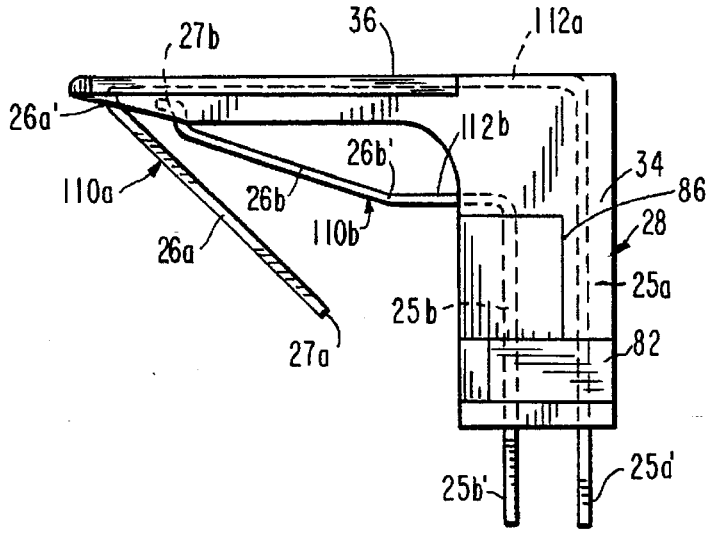
FIG. 4 is a side elevation view of the assembly illustrated in FIG. 3.
Figure 5:
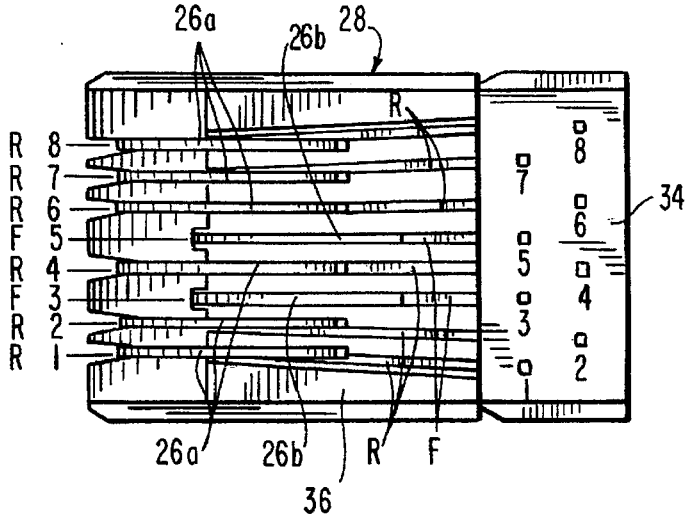
FIG. 5 is a bottom plan view of the assembly illustrated in FIGS. 3 and 4.

Referring to FIGS. 1 and 2, when the two plug contact blades 19*b* at positions P3 and P5 of modular plug 18 engage the respective two forward facing contacts 26*b* at those positions, signals are transmitted from the contact blades through the forward facing contacts 26*b* to the associated terminals 25*b* in the direction of arrow 29*b*, i.e., downwardly towards the back portion 34 of contact housing part 28. On the other hand, still referring to FIGS. 1 and 2, when the six contact blades 19*a* at positions P1, P2, P4 and P6–P8 of modular plug 18 engage the respective six rearward facing contacts 26*a* at those positions, signals are transmitted from the contact blades through the rearward facing contacts 26*a* to the associated terminals 25*a* in the direction of arrow 29*a*, i.e. upwardly and away from the back portion 34 of contact housing part 28. It is seen that the signals transmitted through rearward facing jack contacts 26*a* flow in the opposite direction to that in which the signals transmitted through adjacent forward facing contacts 26*b* flow. In this manner, adjacent first and second contacts 26*a* and 26*b* create electromagnetic fields which tend to cancel each other thereby reducing near-end crosstalk. Crosstalk is further reduced by the fact that the first and second conductor planes containing the first and second conductor portions 116*a* and 116*b* of wires 110*a* and 110*b* are spaced from each other.

The arrangement of forward and rearward facing contacts described above, namely RRFRFRRR will essentially compensate for a split twisted pair where the normal pairing is split up and the individual wires are paired with wires from another pair. However, the invention is not limited to such an arrangement, and alternate wiring configurations will dictate notating forward and rearward facing contacts for optimum cancellation or compensation effects. For example, other arrangements of forward and rearward facing contacts in a connector in accordance with the invention include RFRFRRRR and FRFRRRRR.

Obviously, numerous modifications and variations of the present invention are possible in light of the above teachings. The invention may be applied in connectors other than of a type adapted for use with cables whose wires are assigned to contacts in a manner other than as specified by EIA/TIA standard 568 of ANSI. Thus, the principles of the invention will be utilized in any connector in which signals flow through a set of at least one contact in one direction and in the opposite direction through a set of at least one other contact proximate thereto. For example, the arrangement of forward and rearward facing contacts may vary from that shown and described, e.g., and/or signals may flow from a forward facing contact in one direction to and through a rearward facing contact in another direction. Connectors in accordance with the invention may be other than of a type adapted for connection to printed circuit boards, and other configurations of conductors, terminals and contacts are possible in accordance with the invention. Accordingly, it is understood that other embodiments of the invention are possible in the light of the above teachings.

What is claimed is:

1. An electrical connector, comprising:

a housing having a receptacle face; and a plurality of contacts having contact regions lying substantially along a single line parallel to the receptacle face, said plurality of contacts including a first set of at least one forward facing contact and a second set of at least one rearward facing contact;

the first set of at least one forward facing contact mounted in said housing and a first set of at least one terminal, each of said first set of at least one forward facing contact having a forward end and a rearward end, said rearward end being electrically coupled to a respective one of said first set of at least one terminal such that said forward end of each of said first set of at least one forward facing contact constitutes a free forwardly facing end; and the second set of at least one rearward facing contact mounted in said housing and a second set of at least one terminal, each of said second set of at least one rearward facing contact having a rearward end and a forward end, said forward end being electrically coupled to a respective one of said second set of at least one terminal such that said rearward end of each of said second set of at least one rearward facing contact constitutes a free rearwardly facing end, said at least one rearward facing contact being substantially parallel and laterally adjacent to said at least one forward facing contact.

2. A connector as recited in claim 1, wherein said first set of forward facing contacts comprises a plurality of forward facing contacts arranged substantially parallel to each other, and said second set of rearward facing contacts comprises a plurality of rearward facing contacts arranged substantially parallel to each other.

3. A connector as recited in claim 1, further comprising:

a first set of at least one forward contact/terminal wire, each of said at least one forward contact/terminal wire comprising a length portion defining a respective one of said at least one forward facing contact, a length portion defining a respective one of said first set of at least one terminal, and a length portion defining a conductor electrically coupling said terminal to said rearward end of said forward facing contact, and a second set of at least one rearward contact/terminal wire, each of said at least one rearward contact/terminal wire comprising a length portion defining a respective one of said at least one rearward facing contact, a length portion defining a respective one of said second set of at least one terminal, and a length portion defining a conductor electrically coupling said terminal to said forward end of said rearward facing contact, said length portion defining a respective one of said at least one forward facing contact and said length portion defining a respective one of said at least one rearward facing contact being arranged laterally adjacent one another.

4. A connector as recited in claim 1 wherein said first and second sets of forward and rearward facing contacts include at least two forward facing contacts and at least two rearward facing contacts which alternate in position with each other.

5. A connector as recited in claim 1 wherein said connector includes at least four of said contacts and wherein one of said first and second sets of forward and rearward facing contacts include at least two contacts and the other includes two contacts, and wherein said contacts are arranged such that said contacts comprise two contacts of said one of said first and second sets of forward and rearward contacts and two contacts of said other of said first and second sets of contacts alternate in position with each other.

6. A connector as recited in claim 1 wherein said connector includes eight of said forward facing and rearward facing contacts occupying positions designated 1 to 8, and wherein one of said first and second sets of forward and rearward facing contacts includes six contacts and the other of said first and second sets of contacts includes two contacts, and wherein said forward facing and rearward facing contacts are arranged such that two contacts of said one of said first and second sets of contacts and two contacts of said other of said first and second sets of contacts occupy positions 3 to 6 in alternating relationship with each other, and the remaining four contacts of said one of said first and second sets of contacts occupy positions 1, 2, 7 and 8.

7. A connector as recited in claim 1 wherein said connector includes eight of said contacts occupying positions designated 1 to 8, and wherein said first set of at least one forward facing contact includes two forward facing contacts and said second set of at least one rearward facing contact includes six rearward facing contacts, and wherein said forward facing and rearward facing contacts are arranged to occupy the eight positions as follows: RRFRFRRR, wherein R designates a rearward facing contact and F designates a forward facing contact.

8. A connector as recited in claim 1, wherein said receptacle face constitutes an entrance opening into which a plug is insertable and wherein said housing further has a closed end, said forward end of each of said contacts being arranged closer to said entrance opening than said rearward end of each of said contacts and said rearward end of each of said contact being arranged closer to said closed end than said forward end of each of said contacts such that said contacts extend through said receptacle, said contacts being adapted to provide mechanical and electrical contact with blade contacts in the plug.

9. An electrical connector, comprising:

a housing;

a first set of forward facing contacts mounted in said housing and a first set of terminals, each of said first set of terminals being electrically coupled to a respective one of said forward facing contacts; and a second set of rearward facing contacts mounted in said housing and a second set of terminals, each of said second set of terminals being electrically coupled to a respective one of said rearward facing contacts, said connector including eight of said contacts occupying positions designated 1 to 8, one of said first and second sets of forward and rearward facing contacts includes six contacts and the other of said first and second sets of contacts includes two contacts, said forward facing and rearward facing contacts are arranged such that two contacts of said one of said first and second sets of contacts and two contacts of said other of said first and second sets of contacts occupy positions 3 to 6 in alternating relationship with each other, and the remaining four contacts of said one of said first and second sets of contacts occupy positions 1, 2, 7 and 8.

10. A connector as recited in claim 9, wherein said first set of forward facing contacts are substantially parallel to each other, and said second set of rearward facing contacts are substantially parallel to each other and substantially parallel and laterally adjacent to said first set of forward facing contacts.

11. A connector as recited in claim 9, wherein each of said first set of forward facing contacts include a forward free end and a rearward end electrically coupled to a respective one of said first set of terminals, and each of said second set of rearward facing contacts include a rearward free end and a forward end electrically coupled to a respective one of said second set of terminals.

12. A connector as recited in claim 9, further comprising:

a first set of forward contact/terminal wires, each of said forward contact/terminal wires comprising a length portion defining a respective one of said forward facing contacts, a length portion defining a respective one of said first set of terminals, and a length portion defining a conductor electrically coupling said terminal to a rearward end region of said forward facing contact, and a second set of rearward contact/terminal wires, each of said rearward contact/terminal wires comprising a length portion defining a respective one of said rearward facing contacts, a length portion defining a respective one of said second set of terminals, and a length portion defining a conductor electrically coupling said terminal to a forward end region of said rearward facing contact.

13. An electrical connector, comprising:

a housing;

a first set of forward facing contacts mounted in said housing and a first set of terminals, each of said first set of terminals being electrically coupled to a respective one of said forward facing contacts; and a second set of rearward facing contacts mounted in said housing and a second set of terminals, each of said second set of terminals being electrically coupled to a respective one of said rearward facing contacts, said connector including eight of said forward facing and rearward facing contacts occupying positions designated 1 to 8, said first set of forward facing contacts including two forward facing contacts and said second set of rearward facing contacts including six rearward facing contacts, and wherein said forward facing and rearward facing contacts are arranged to occupy the eight positions as follows: RRFRFRRR, wherein R designates a rearward facing contact and F designates a forward facing contact.

14. A connector as recited in claim 13, wherein said first set of forward facing contacts are substantially parallel to each other, and said second set of rearward facing contacts are substantially parallel to each other and substantially parallel and laterally adjacent to said first set of forward facing contacts.

15. A connector as recited in claim 13, wherein each of said first set of forward facing contacts include a forward free end and a rearward end electrically coupled to a respective one of said first set of terminals, and each of said second set of rearward facing contacts include a rearward free end and a forward end electrically coupled to a respective one of said second set of terminals.

16. A connector as recited in claim 13, further comprising:

a first set of forward contact/terminal wires, each of said forward contact/terminal wires comprising a length portion defining a respective one of said forward facing contacts, a length portion defining a respective one of said first set of terminals, and a length portion defining a conductor electrically coupling said terminal to a rearward end region of said forward facing contact, and a second set of rearward contact/terminal wires, each of said rearward contact/terminal wires comprising a length portion defining a respective one of said rearward facing contacts, a length portion defining a respective one of said second set of terminals, and a length portion defining a conductor electrically coupling said terminal to a forward end region of said rearward facing contact.

17. An electrical conductor comprising:

a housing having a receptacle face;

a plurality of elongate contacts, each of said contacts having a first forward end region and a second rearward end region, said plurality of contacts having contact regions lying substantially along a single line parallel to the receptacle face;

a plurality of terminals;

a first conductor for interconnecting at least one first contact from said first forward end region thereof to a respective one of said terminals, said second rearward end region of said first contact constituting a free rearwardly facing end region; and a second conductor for interconnecting at least one second contact situated adjacent to said first contact from said second rearward end region thereof to a respective one of said terminals, said first forward end region of said second contact constituting a free forwardly facing end region.

18. A connector as recited in claim 17, wherein said contacts are situated in a substantially common contact plane.

19. A connector as recited in claim 17, wherein said contacts comprise spring contacts, each of said at least one first contact being joined to said first conductor at a first pivot point located in the region of a respective one of said first end regions, and said at least one second contact being joined to said second conductor at said second end regions.

20. A connector as recited in claim 17, wherein said terminals of said first set of terminals are substantially situated in a first common terminal plane and said terminals of said second set of terminals are substantially situated in a second common terminal plane spaced from and substantially parallel to said first terminal plane.

21. A connector as recited in claim 17, wherein said first conductor comprises substantially parallel elongate conductors substantially situated in a common first conductor plane and said second conductor comprises substantially parallel elongate conductors substantially situated in a common second conductor plane spaced from said first conductor plane.

22. A connector as recited in claim 21, wherein said second conductor plane extends obliquely with respect to said first conductor plane.

23. A modular jack comprising:

a dielectric housing defining a receptacle having a face for receiving a modular plug, said housing including a contact housing part having a top portion and a back portion; and a plurality of elongate contacts arranged substantially parallel to each other and extending between top, front regions proximate to said top portion of said contact housing part and bottom, rear regions, said plurality of contacts having contact regions lying substantially along a single line parallel to the receptacle face, a plurality of terminals situated at least in part in said back portion of said contact housing part, a first conductor for interconnecting a first set of said contacts from said top, front regions thereof to respective ones of a first set of said terminals, said bottom, rear regions of said contacts of said first set of contacts constituting a free rearwardly facing end region; and a second conductor for interconnecting a second set of said contacts from said bottom, rear regions thereof to respective ones of a second set of said terminals, said top, front region of said contacts of said second set of contacts constituting a free forwardly facing end region.

24. A jack as recited in claim 23, wherein said terminals of said first set of terminals are substantially situated in a first common terminal plane and said terminals of said second set of terminals are substantially situated in a second common terminal plane spaced from and substantially parallel to said first common plane.

25. A jack as recited in claim 23, wherein said first conductor comprises substantially parallel elongate first conductors situated on said top portion of said contact housing part in a substantially common first conductor plane, and said second conductor comprises substantially parallel elongate second conductors extending through said back portion of said contact housing part and substantially situated in a common second conductor plane spaced from and extending obliquely with respect to said first conductor plane.

26. A jack as recited in claim 23, wherein, said first conductor comprises first conductors situated on said top portion of said contact housing part, each of said first conductors interconnecting one of said first set of contacts to a respective terminal of said first set of terminals, and said second conductor comprises second conductors extending at least in part through said back portion of said contact housing part, each of said second conductors interconnecting one of said second set of contacts to a respective one of said second set of terminals.

27. A jack as recited in claim 26, wherein, each of said first set of contacts, first set of terminals, and first conductors interconnecting the same are formed by an elongate resilient wire, each resilient wire including a length portion situated on said top portion of said contact housing part defining said first conductor and a length portion bent around a free end of said top portion of said housing part and extending into said plug receptacle defining said contact, and wherein each of said second set of contacts, second set of terminals and second conductors interconnecting the same are formed by an elongate resilient wire, each resilient wire including a length portion extending at least in part through said back portion of said contact housing part defining said second conductor and a length portion extending from said second conductor into said plug receptacle defining said contact.

28. A jack as recited in claim 27, wherein said terminals of said first and second sets of terminals extend through bores formed in said back portion of said contact housing part.

29. A jack as recited in claim 27, wherein said housing further includes an outer housing part including a separator wall defining a plurality of guide slots, each of said contacts being received in a respective guide slot.

30. An electrical connector comprising:

a housing having a receptacle face;

a plurality of elongate contacts extending between top, front and bottom, rear regions, said plurality of contacts having contact regions lying substantially along a single line parallel to the receptacle face;

a plurality of terminals;

a first conductor for interconnecting a first set of said contacts from said top, front regions thereof to respective ones of a first set of terminals, said first conductor comprising substantially parallel elongate conductors situated in a common first conductor plane, said bottom, rear regions of said contacts of said first set of contacts constituting a free rearwardly facing end region; and a second conductor for interconnecting a second set of said contacts from said bottom, rear regions thereof to respective ones of a second set of said terminals, said second conductor comprising substantially parallel elongate conductors situated in a common second conductor plane spaced from said first conductor plane, said top, front region of said contacts of said second set of contacts constituting a free forwardly facing end region.

31. A connector as recited in claim 30, wherein said contacts comprise spring contacts, said first set of contacts being joined to said first conductors at first pivot points located in the regions of said top, front regions, and said second set of contacts being joined to said second conductors at said second end regions.

32. A connector as recited in claim 30, wherein said second conductor plane extends obliquely with respect to said first conductor plane.

* * * * *